United States Patent [19]

Wendt

[11] 4,281,481

[45] Aug. 4, 1981

[54] FIRE RESISTANT ALUMINUM DOOR FRAME ASSEMBLY

[75] Inventor: Alan C. Wendt, Barrington, Ill.

[73] Assignee: United States Gypsum Company, Chicago, Ill.

[21] Appl. No.: 113,429

[22] Filed: Jan. 18, 1980

[51] Int. Cl.[3] ..... E06B 1/12

[52] U.S. Cl. ..... 49/504; 52/211; 52/213

[58] Field of Search ..... 49/501, 504; 52/211, 52/213

[56] References Cited

U.S. PATENT DOCUMENTS

| | | | |
|---|---|---|---|
| 3,676,966 | 7/1972 | Ragland | 49/504 X |
| 3,886,688 | 6/1975 | Ragland | 49/504 |
| 3,889,423 | 6/1975 | Begin | 49/504 |
| 3,964,214 | 6/1976 | Wendt | 49/504 X |
| 4,223,494 | 9/1980 | Wendt | 49/504 X |

*Primary Examiner*—Kenneth Downey
*Attorney, Agent, or Firm*—Glenn W. Ohlson; Samuel Kurlandsky; Robert H. Robinson

[57] ABSTRACT

A fire resistant aluminum door frame assembly is provided which comprises a partition wall having a door opening therethrough; a header assembly; opposing jamb assemblies; a strike assembly disposed along one jamb assembly; at least one hinge assembly disposed along the opposite jamb assembly; and a door member supported within said door opening by said hinge assembly and having a lockset engaging said strike assembly; whereby upon exposure to extreme heat, the door frame assembly accommodates expansion of the header and jamb assemblies without buckling, and said strike and hinge assemblies respectively maintain said door support and lockset engagement of the door member, wherein said door frame assembly attains a fire rating.

23 Claims, 10 Drawing Figures

FIRE RESISTANT ALUMINUM DOOR FRAME ASSEMBLY

BACKGROUND OF THE INVENTION (1) Field of the Invention

The invention relates to a fire resistant aluminum door frame assembly whereby upon exposure to extreme heat, the door frame assembly accommodates expansion of header and jamb assemblies without buckling and strike and hinge assemblies respectively maintain door support and lockset engagement of a door member wherein said door frame assembly attains a fire rating.

(2) Description of the Prior Art

Present day partition wall construction utilizes many door framing constructions. It is preferable that a metal door frame be utilized since the use of wooden framing has become too costly and also diminishes the fire resistancy of the entire partition wall construction. The problem with utilization of metal members is that the thermal coefficient of expansion is much greater than when wooden members are used. Upon exposure to extreme heat, metal members tend to expand and buckle. If the buckling is not retarded, gaps along the door and door frame occur and thus provide avenues of passage for heat, smoke and combustion. It has thus become a concern of the industry to solve this problem. An additional problem has ensued with regard to the use of aluminum door framing. Aluminum members are highly desirable due to their light weight and attractive appearance. Additionally, the ease of extruding aluminum members makes them even more desirable. At elevated temperatures, aluminum tends to soften and door support can be lost in addition to the harmful side effects of buckling. Aluminum jamb members are generally about twice the length of header members and thus the linear expansion of these members must be accommodated much more than the concomitant expansion of header members. Generally, few fire rated aluminum door frame systems are extant in the prior art, and those that are involve the utilization of unconventional studs for accommodation of particularly formed jamb and header members for utilization therewith. It would be desirable to utilize conventional wood or steel stud members such that the cost of the door frame would not thereby be increased. Additionally, previous encounters with this problem have sought to include cap members extending across the top of the door opening with a slideable facia plate which can slide past upper portions of the jamb assemblies. Such solutions, however, prohibit attaining expansion accommodation of the jamb assemblies which must be accomodated in conjunction with this header expansion. Additionally this past utilization of aluminum door framing does envision reversibility of jamb members such that a left hand or right hand swinging door can be accommodated within a door opening and partition wall construction. Also, numerous frames require many elements which increase the cost of the frame. It would be desirable to reduce the number of frame members when using aluminum elements and still provide continuous door support upon exposure to extreme heat.

In conjunction with the problems noted in the prior art, it is additionally an esthetic concern to provide a strike assembly which comprises aluminum and creates the pleasing appearance of a continuous aluminum set of elements.

(3) Objects of the Invention

Accordingly, it is a primary object of the invention to provide an aluminum door frame for use with partition wall construction which accommodates expansion of header and jamb members upon exposure to extreme heat.

It is an allied goal of the invention to provide such an aluminum door frame for use with conventional stud means and eliminate the need for specifically shaped mating stud members for use with header and jamb assemblies.

It is an important object of the invention to additionally maintain door support upon exposure to heat.

It is a concomitant object of the invention to provide a strike assembly comprising aluminum to afford a continuous aluminum esthetically pleasing appearance.

Another object of the invention is to reduce the number of components in an aluminum door frame assembly which still provides fire resistancy.

A related goal of the invention is to provide an aluminum door frame assembly which facilitates ease of installation by conventional screw attachment.

SUMMARY OF THE INVENTION

All the foregoing goals, objects and aims of the invention are attained by the provision of a fire resistant aluminum door frame assembly. The assembly comprises a partition wall having a door opening therethrough with stud means adjacent opposing vertical sides of the opening. A header assembly is included which has expansion cavity means at opposite upper portions of the door opening, a channel-shaped aluminum header member extending between the cavities and screw attached to said partition wall, aluminum snap-engageable trim members concealing said screw attachment, said trim members having upper and lower snap-engageable legs engaging upper and lower snap-engageable portions of said header member, the lower snap-engageable portion terminating short of opposite ends of the header member, and said header member including doorstop means extending for substantially the full width of said member. The assembly further comprises opposing jamb assemblies disposed along opposing sides of said door opening and extending downwardly from said header assembly below the expansion cavities, said jamb assembly having channel-shaped aluminum jamb members screw attached to said partition wall, aluminum snap-engageable trim members concealing said screw attachment, said trim members having snap-engageable legs engaging snap-engageable portions of said jamb members, and said jamb members including doorstop means extending for substantially the full height of the jamb members, and, an engageable longitudinal slot, adjacent said doorstop, having a mortising trim strip engaged therein. The fire resistant aluminum door frame assembly includes a strike assembly disposed along one jamb assembly at said engageable slot for accommodation of lockset means of a door member, said strike assembly having an exterior aluminum stike plate member with an opening therethrough permitting entrance of bolt from a lockset, and further having an interior steel angle member separately screw attached to said jamb member, said steel angle providing retentive engagement for a bolt from a lockset. The assembly comprises at least one hinge assembly disposed along the opposite jamb assembly at said engageable slot, said hinge assembly having an exterior steel hinge plate screw-attached to an interior steel back-up plate, the steel back-up plate being separately screwattached to said jamb member. The assembly includes a door member supported within said door opening by said hinge assembly and having a lockset engaging said strike assembly. Whereby the assembly, upon exposure to extreme heat, accommodates expansion of the header and jamb assemblies without buckling, and said strike and hinge assemblies respectively maintain said door support and lockset engagement of the door member wherein said door frame assembly attains a fire rating.

A BRIEF DESCRIPTION OF THE DRAWINGS

DESCRIPTION OF THE PREFERRED EMBODIMENTS

Figure 1:
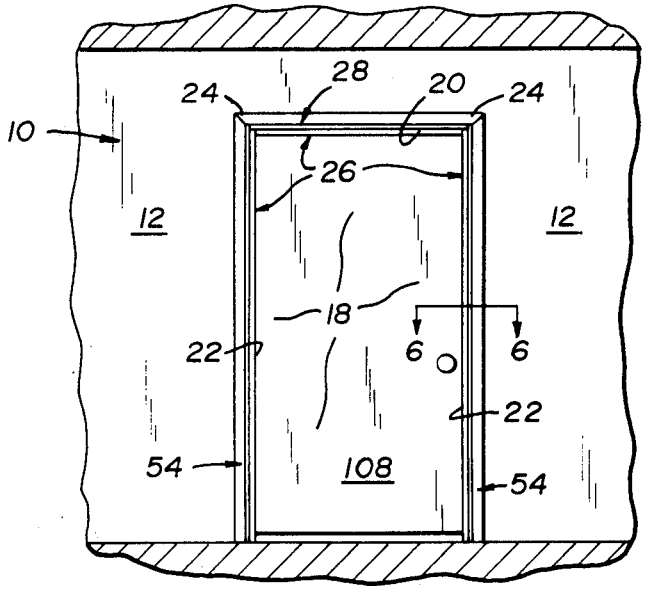
FIG. 1 is an elevational view of a partition wall construction having the preferred embodiment for the fire resistant aluminum door frame assembly of this invention included.

Reference is first made with respect to FIG. 1 wherein the overall assembly of elements is shown in the fully installed alignment. Partition wall construction 10 having panels 12 is illustrated in a front elevational view. Therein, a door opening 18 is provided therethrough having a top side 20 and opposing vertical sides 22. Opposing vertical sides 22 meet top side 20 at corners 24. Door frame assembly 26 in the preferred embodiment of this invention is also shown comprising header assembly 28 and jamb assembly 54. A door member 108 is supported within door opening 18 by door frame assembly 26. The invention has particular utilization in partition wall construction 10 having the conventional partition-type construction with spaced apart panels 12, preferably comprising gypsum.

Figure 2:
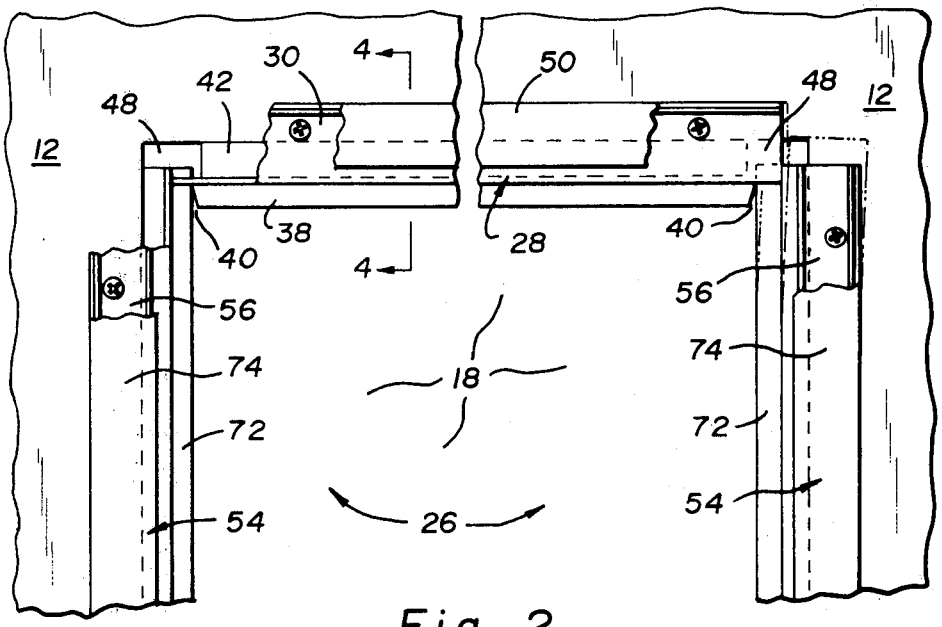
FIG. 2 is a partially broken away front elevational view of the fire resistant aluminum door frame assembly of this invention as shown in FIG. 1.

FIG. 2 illustrates door frame assembly 26 partially broken away. Header assembly 28 comprises header member 30 which is covered on both sides of door opening 18 by snap-on trim 50. At both ends of header member 30, expansion cavities 48 are provided for the vertical expansion of jamb members 56 of jamb assembly 54 as well as a lesser horizontal expansion of header member 30 upon exposure to extreme heat from a fire or the like. Doorstop 38 is included in header member 30 as shown and is provided with bevelled ends 40, and notched back from the opposite ends of header member 30 a distance substantially the same as the distance doorstop 72 of later-described jamb member 56 projects outwardly from jamb member 56. Ends 40 are also provided with bevelling of from 0° to about 10° inwardly from doorstop 72 of jamb member 56. This termination and bevelling permits doorstop 72 to expand upwardly without displacing jamb member 56 by allowing doorstop 72 to pass through the notched-out portions at the ends of header member 30. As illustrated in the upper right hand corner of FIG. 2, in phantom lines, the expansion of jamb member 56 is shown as it would be positioned upon vertical expansion during such exposure to heat. Snap-on trim 74 is partially removed for illustrative purposes at both sides of door opening 18. Gypsum block 42 is disposed above header member 30 for reinforcment.

Figure 3:
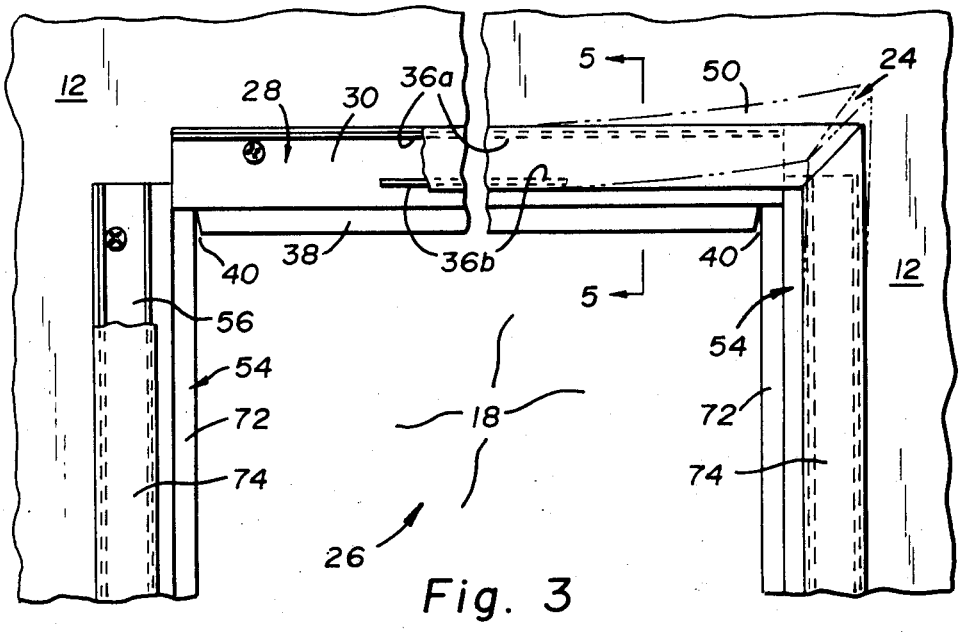
FIG. 3 is a front elevational view similar to FIG. 2 and being partially broken away to show the expansion accommodation characteristic of the invention.

With emphasis now on FIG. 3, door frame assembly 26 is shown with regard to the horizontal expansion of snapon trim 50 of header assembly 28 and vertical expansion of snap-on trim 74 of jamb assembly 54. At corners 24, a mitered configuration is disclosed for the jointing of snap-on trim 74 and snap-on trim 50 to provide an esthetically pleasing appearance. Snap-on trim 50 engages snap-engageable portions **36*a* and 36*b* being upper and lower engageable portions header member 30 respectively. Snap-engageable portions 36*b*, being the lower of the portions, is terminated short of the ends of header member 30, thus permitting snap-on trim 50 to move upwardly without deleterious displacement of header member 30. Snap-engageable portions 36*a* are provided for substantially the full width of header member 30. Thus as seen in phantom, snap-on trim 74 can move upwardly and urge the snap-on trim 50 upwardly without harmfull distortion of header members 30 or jamb member 56. The bevelled ends 40 permit doorstop means 72 to pass upwardly and slide past header member 30 without harmful contact occurring. The header member 30 can move horizontally during heat expansion into expansion cavities 48 and jamb members 56 can move vertically into expansion cavities 48** through avoiding harmful buckling of these members.

Figure 4:
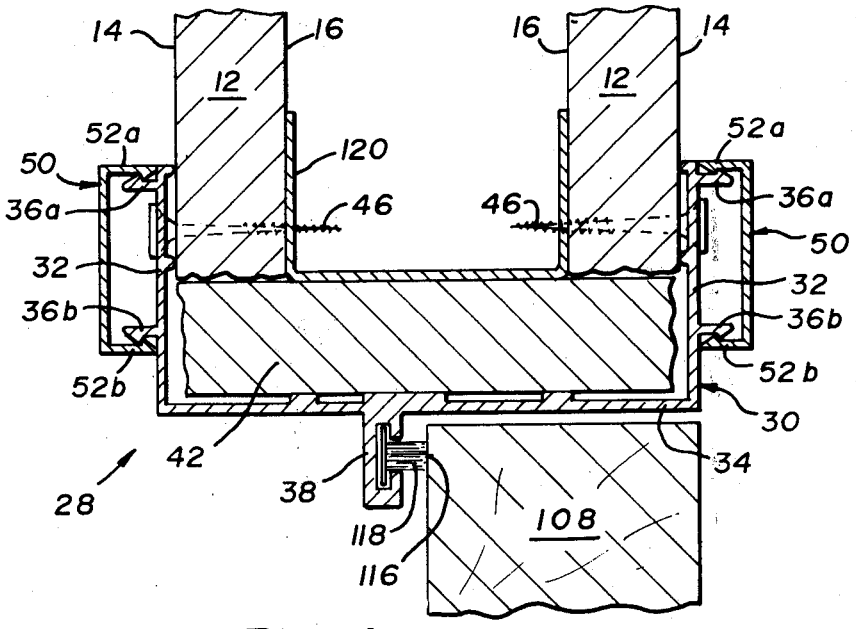
FIG. 4 is a cross-sectional view of the header assembly for the preferred embodiment of this invention taken along lines 4—4 of FIG. 2 looking in the direction of the arrows.

With more specific reference to header assembly 28, FIG. 4 provides greater detail thereof. FIG. 4 is a cross-sectional view of header assembly 28 taken along lines 4—4 of FIG. 2 looking in the direction of the arrows. Spaced-apart rows of panels 12 are shown with steel channel 120 supportively disposed therebetween in a conventional manner. Panels 12 have exterior faces 14, and interior faces 16 in opposing relationship. Steel channel 120 supportively contacts interior faces 16 as shown. Header assembly 28 comprises header member 30 having a channel-shape with upwardly extending spaced apart legs 32 interconnected by generally horizontally disposed web 34. Legs 32 are screw attached by screw attachment means 46 through panels 12 to steel channel 120. Legs 32 further include said snap-engageable portions **36*a* and 36*b* which extend outwardly therefrom. Snapengageable portions 36*a* and 36*b* provide the means whereby snap-on trim 50, having upper and lower legs 52*a* and 52*b*, may be engaged thereby covering screw attachment means 46 and providing a continuous esthetically pleasing appearance. Snap-on trim 50 and header member 30 preferably comprise extruded aluminum. Gypsum block 42 is shown extending between steel channel 120 and web 34 of header member 30 for reinforcement and support therebetween. Web 34 further includes a downwardly projecting doorstop 38 generally centrally located thereon. Doorstop 38 is grooved in a conventional manner for accommodation of mute 118. Mute 118 preferably comprises a non-degradable material such as nylon pile which does not burn-out upon exposure to extreme heat thereby providing a continuous contact surface for door member 108 along its peripheral edge 116. Peripheral edge 116 is generally described as the portion of the door which abuts along doorstop means. Screw attachment means 46 are preferably provided as conventional self-drilling self-tapping screws for attachment through panels 12 into steel channel 120**.

Figure 5:
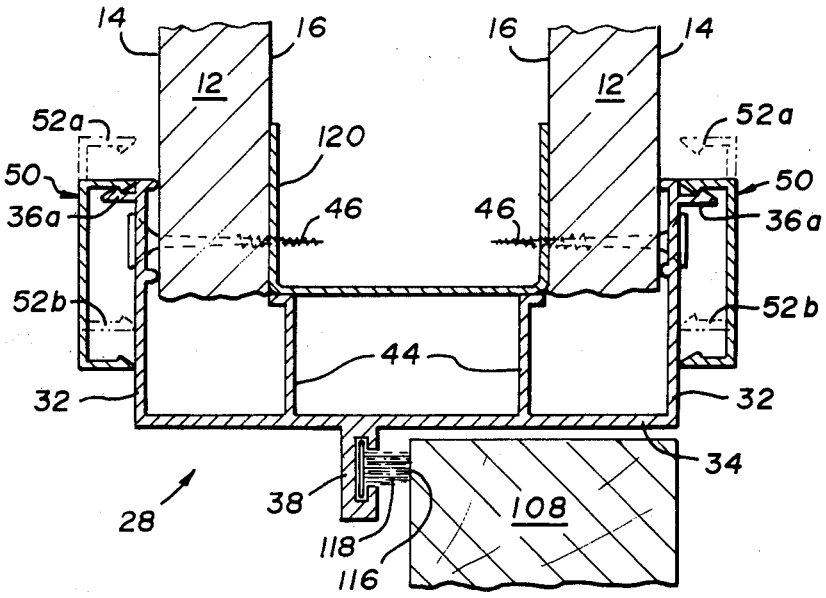
FIG. 5 is a cross-sectional view of the header assembly for the preferred embodiment of this invention showing an alternate construction thereof taken along lines 5—5 of FIG. 3 looking in the direction of the arrows.

FIG. 5 illustrates the displacement of snap-on trim 50 upon exposure to extreme heat. FIG. 5 is a cross-sectional view taken along lines 5—5 of FIG. 3 looking in the direction of the arrows. The vertical displacement of snap-on trim 50 is illustrated in phantom. As stated, lower snap-engageable portions **36*b* are removed at the opposite ends of header member 30 thus allowing legs 52*b* to move unimpeded upwardly such that snap-on trim 74, upon vertical movement, does not harmfully buckle since it is allowed to displace snap-on trim 50 with this provision. FIG. 3 when viewed in conjunction with FIG. 5 illustrates this solution to the previously encountered buckling problems when using aluminum door frame construction. FIG. 5 further illustrates an alternate for the configuration of header member 30. This alternate preferred configuration includes intermediate legs 44 spaced-apart and disposed between legs 32 in replacement of gypsum block 42. Support between steel channel 120 and web 34 is thereby attained in this alternate embodiment. The reference numerals in FIG. 5 otherwise correspond to the reference numerals of FIG. 4** as recited above.

Figure 6:
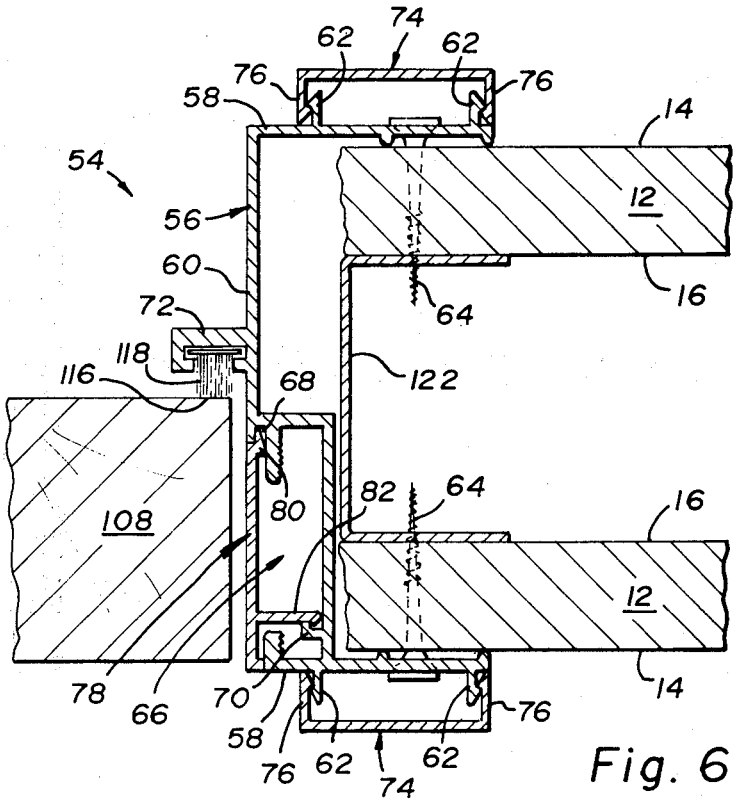
FIG. 6 is a cross-sectional view taken along line 6—6 of FIG. 1 looking in the direction of the arrows showing the preferred embodiment of the jamb asembly in accordance with this invention.

FIG. 6 is a cross-sectional view taken along line 6—6 of FIG. 1 looking in the direction of the arrows. This Figure shows the preferred embodiment for jamb assembly 54 of door frame assembly 26. Jamb assembly 54 comprises a jamb member 56 having spaced-apart legs 58 interconnected by web 60. Legs 58 are attached by screw attachment means 64. Screw attachment means 64 are preferably self-drilling self-tapping screws facilitating attachment of jamb member 56 through panel 12 into stud means 122. Stud means 122 is preferably disclosed as having a conventional stud construction with a channel-shape and disposed with a web perpendicular to interior panel faces 16 of panels 12. Jamb member 56 further includes snap-engageable portions 62 which afford snap-engagement for snap-on trim 54 at legs 76 thereof. Thereby, snap-on trim 74 covers screw attachment means 64 to provide a continuous esthetically pleasing aluminum appearance. Jamb member 56 and snap-on trim 74 are preferably comprised of extruded aluminum for use in door frame assembly 26. Web 60 futher includes an intermediate doorstop 72 projecting inwardly of door opening 18. Doorstop 72 is preferably grooved for accomodation of mute 118 which contacts previously described peripheral edge 116 of door member 108. Generally adjacent doorstop 72 resides engageable slot 66 having a groove 68 and node 70 therein for affixation of later-described elements. Extending longitudinally for substantially the full height of jamb member 56 is mortising trim strip 78. Mortising trim strip 78 is engaged at engageable slot 66 by means of a lip 80 engaged within groove 68 and barb 82 snap-engaging node 70. Mortising trim strip 78 provides a generally planar esthetically pleasing surface adjacent doorstop 72. As with jamb member 56 and snap-on trim 74, mortising trim strip 78 preferably comprises extruded aluminum but may also be alternately provided as an extruded vinyl material, or equivalent. Snap-on trim 74, being snap-engaged to snap-engageable portion 62 of jamb member 56, is permitted to vertically expand in an unrestricted manner upon exposure to extreme heat thereby preventing harmful buckling.

Figure 7:
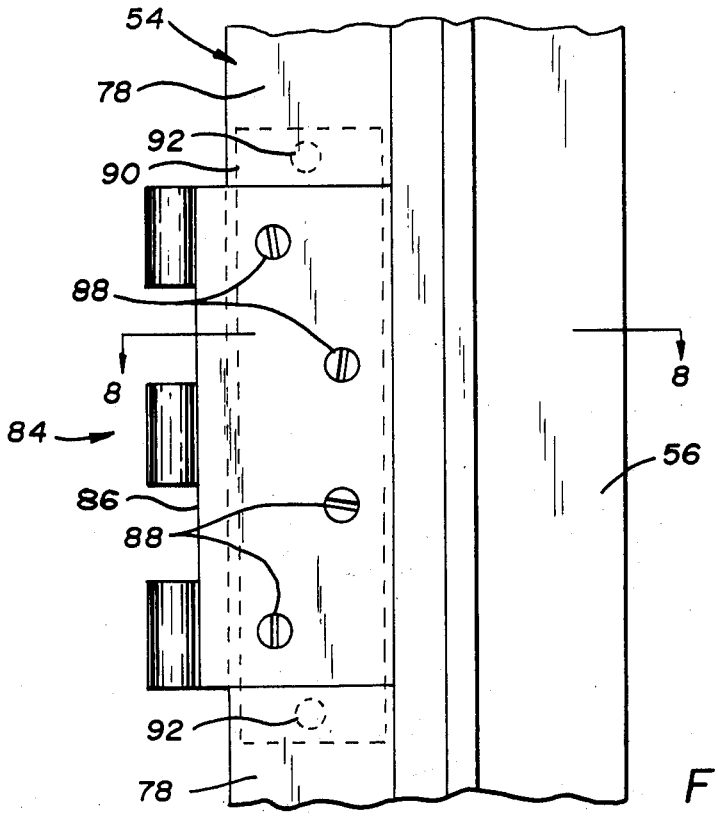
FIG. 7 is a side view of the hinge assembly for the preferred embodiment of this invention disposed along the jamb assembly.
Figure 8:
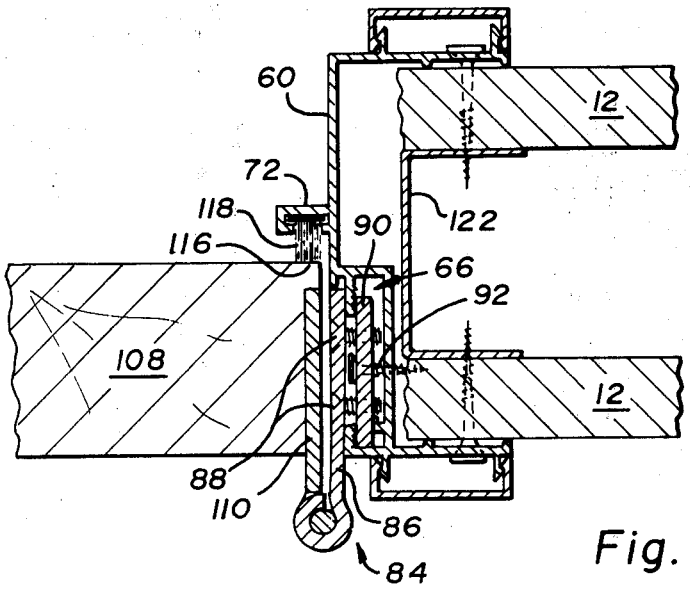
FIG. 8 is a cross-sectional view taken along lines 8—8 of FIG. 7 looking in the direction of the arrows showing the hinge assembly of this invention.

In conformance with the preferred embodiment of the invention, reference is now taken with respect to FIG. 7, which shows hinge assembly 84 disposed along jamb assembly 54 at jamb member 56 along one of the opposing vertical sides 22. Hinge assembly 84 is disposed along jamb member 56 at engageable slot 66. Hinge assembly 84 comprises a hinge plate 86 which is affixed to back-up plate 90 by screw attachment means 88. Screw attachment means 88 are preferably self-drilling self-tapping screws adapted to screw-engage backup plate 90, which preferably comprises steel for proper attachment thereto. Back-up plate 90 resides within engageable slot 66 as shown when taken with reference to FIG. 8 and FIG. 7 conjunctively. Back-up plate 90 is separately screw-attached to jamb member 56 by means of screw attachment means 92 as shown. Screw attachment means 92 preferably comprise self-drilling self-tapping screws widely known to the industry. Because jamb member 56 comprises aluminum, the utilization of steel for back-up plate 90 allows for proper support attachment of door member 108 upon exposure to extreme heat, since aluminum softens considerably at elevated temperatures. Door member 108 is connected to hinge assembly 84 by means of mating with hinge means 110, well known in the door frame construction industry. Hinge plate 86 resides along engageable slots 66 in a generally co-planar vertical relationship with mortising trim strip 78. Mortising trim strip 78 extends above and below hinge plate 86 thereby providing a continuous esthetically pleasing uniform co-planar appearance. In the preferred embodiment, hinge assembly 84 is provided at three locations for interconnection with hinge means 110 of door member 108. However, within the scope of this invention, any reasonable amount of hinge attachment locations may be provided in accordance with the specific weight and design considerations of a particular construction.

Figure 9:
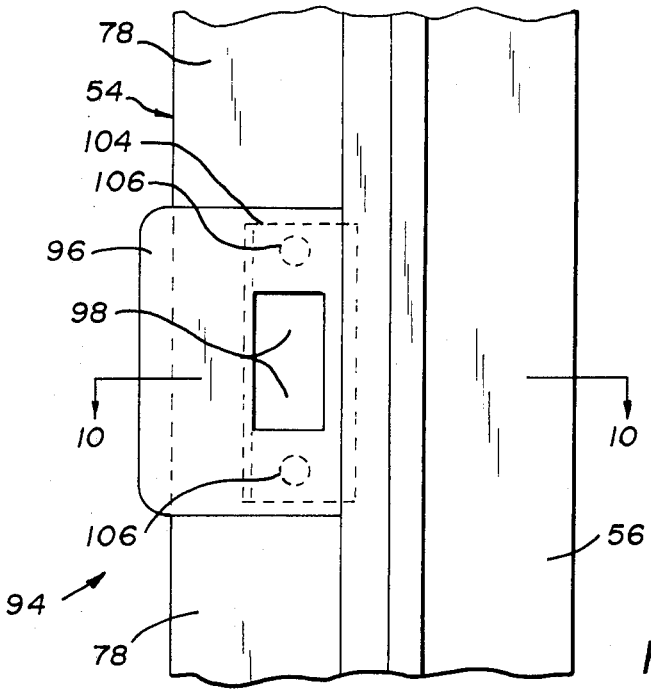
FIG. 9 is a side view of the strike assembly disposed along the jamb assembly in the preferred embodiment of this invention.
Figure 10:
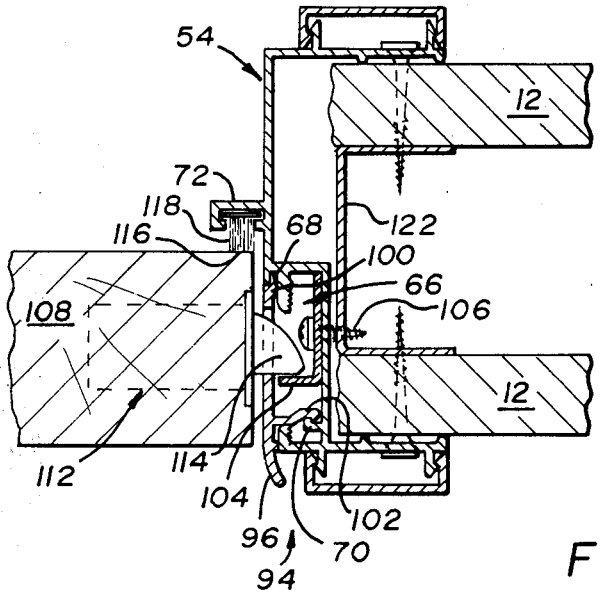
FIG. 10 is a cross sectional view taken along line 10—10 of FIG. 9 looking in the direction of the arrow showing the strike assembly of this invention.

At the opposing vertical side 22 of door opening 18, strike assembly 94, as shown in FIGS. 9 and 10, is provided along the jamb member 56 at that side of door opening 18. Strike assembly 94 is engaged to jamb member 56 along engageable slot 66. Strike assembly 94 comprises stike plate 96 having opening 98 therethrough for accommodation of bolt 114 of lockset 112, which are conventional features included in door member 108, as would be clear to one skilled in the art. Strike plate 96 is engaged along engageable slot 66 by means of lip 100 engaged within groove 68 and barb 102 snap-engaged to node 70. Barb 102 is an S-shape to prevent shear forces from displacing strike plate 96 from position during attempts at opening door member 108 while lockset 112 is engaged. Strike plate 96 resides in generally co-planar vertical relationship with mortising trim strip 78 extending vertically above and below. Thus a continuous co-planar esthetically pleasing surface is provided. Strike plate 96 comprises aluminum and as such will become molten upon exposure to extreme heat. Therefore, steel angle 104 is further provided for proper affixation thereto and proper retentive engagement of bolt 114. Steel antle 104 is separately attached, by screw attachment means 106, to jamb member 56. Screw attachment means 106 preferably comprises self-drilling self-tapping screws for proper engagement. In the embodiment shown, screw attachment means 106 additionally penetrates stud means 122 for additional securement. Steel angle 104 has a generally L-shape and the retentive flange contacting bolt 114 is provided in sufficient length within enagageable slot 66 so that proper securement of door member 108 is provided during distortion caused by increased temperature.

As disclosed in its preferred embodiment, and within the wide scope of this invention, door frame assembly 26 provides a 45 minute Class "C" fire rating in compliance with the following: American Society of Testing and Materials, Test E-152 (1976); Underwriter's Laboratories, Test 10(*b*) (1974); National Fire Protection Association, Test 252 (1972); and, Uniform Building Code, Test 42-2(1976).

Thus header member 30 of header assembly 28 is not harmfully carried vertically with jamb members 56 of jamb assembly 54 upon exposure to heat. Also, expansion of aluminum elements does not impart buckling forces to steel rough framing. The expansion cavities 48 allow for the horizontal expansion of header member 30 and vertical expansion of jamb member 56 in accomplishing the solution to the discused problems. Generally jamb members 56 will expand to approximately $\frac{5}{8}$" during fire testing procedures in attaining the 45 minute fire rating. In additionally limiting the amount of force exerted on header member 30, the termination of lower legs 52*b* from greater than 0" to about 12" from the ends of header member 50 has been provided. Continuous support for door member 108 is additionally provided by the utilization of steel back-up plate 90 for hinge assembly plate 84 and steel angle 104 for strike assembly 94. Since aluminum tends to become molten at elevated temperatures, the utilization of these steel members provides secure yet concealed engagement. Conventional rough steel framing, indicated as conventional channel-shaped studs 122 and steel channel 122, may be utilized in conjunction with door frame assembly 26, thus eliminating the need for specially formed mating non-conventional elements. Door frame assembly 26 preferably utilizes extruded aluminum components which may be easily manufactured without unnecessary elaborate manufacturing techniques. Installation time is reduced and simplified with the utilization of the relatively few elements comprising door frame assembly 26. A mortised co-planar appearance along engageable slot 66 of jamb member 56 is provided by the utilization of mortising trim strip 78 in conjunction with hinge plate 86 of hinge assembly 84 and strike plate 96 of strike assembly 94.

It is thus seen that all the aims, objects and goals of the invention are attained by the invention as disclosed. While reference has been made to a particular preferred embodiment, it will be well understood it is intended that the invention include a wide ranging scope within the intent and purposes herein specified and claimed.

What is claimed is:

1. A fire resistant aluminum door frame assembly comprising;

a partition wall having a door opening therethrough with stud means adjacent opposing vertical sides of the opening;

a header assembly having expansion cavity means at opposite upper portions of the door opening, a channel-shaped aluminum header member extending between the cavity means and screw attached to said partition wall along the upper horizontal side of the door opening, aluminum snap-engageable trim members concealing said screw attachment, said trim members having upper and lower snap-engageable legs engaging upper and lower snap-engageable portions of said header member, the lower snap-engageable portion terminating short of opposite ends of the header member, said header member including doorstop means projecting downward from, and extending for substantially the full width of, the header member;

opposing jamb assemblies disposed along opposing sides of said door opening and extending downwardly from said header assembly below the expansion cavity means said jamb assembly having channel-shaped aluminum jamb members screw attached to said partition wall,aluminum snap-engageable trim members concealing said screw attachment, said trim members having snap-engageable legs engaging snap-engageable portions of said jamb members, said jamb members including doorstop means projecting outward from, and extending for substantially the full height of, the jamb members, and, an engageable longitudinal slot, adjacent said doorstop, having a mortising trim strip engaged therein;

a strike assembly disposed along one jamb assembly at said engageable slot for accommodation of lockset means of a door member, said strike assembly having an exterior aluminum strike plate members with an opening therethrough permitting entrance of a bolt from a lockset, and further having an interior steel angle member separately screw attached to said jamb member, said steel angle providing retentative engagement for a bolt from a lockset;

at least one hinge assembly disposed along the opposite jamb assembly at said engageable slot, said hinge assembly having an exterior steel hinge plate screw attached to an interior steel back-up plate, the steel back-up plate being separetely screw attached to said jamb member and, a door member supported within said door opening by said hinge assembly and having a lockset engaging said strike assembly;

whereby upon exposure to extreme heat, the door frame assembly accommodates expansion of the header and jamb assembly without buckling, and said strike and hinge assemblies respectively maintain said door support and lockset engagement of the door member, wherein said door frame assembly attains a fire rating.

2. A fire resistant aluminum door frame assembly as claimed in claim 1 wherein the lower snap-engageable portion of the header member terminates a distance short of the opposite ends of the header member in the range of from greater than 0" to about 12".

3. A fire resistant aluminum door frame assembly as claimed in claim 1 wherein a gypsum header block is disposed within the channel-shaped header member and extends for substantially the full width of the header member.

4. A fire resistant aluminum door frame assembly as claimed in claim 1 wherein the header member of the header assembly includes two intermediate vertical legs within the channel-shape which extends for substantially the full width of the header member.

5. A fire resistant aluminum door frame assembly as claimed in claim 1 wherein the header assembly trim members and jamb assembly trim members meet at opposite upper corners of the door opening in a mitered relationship.

6. A fire resistant aluminum door frame assembly as claimed in claim 1 wherein the partition wall comprises two parallel spaced apart rows of gypsum board with the stud means being steel channel-shaped members positioned adjacent the door opening with webs of the channel-shapes disposed generally perpendicular to the rows of gypsum board.

7. A fire resistant aluminum door frame assembly as claimed in claim 1 wherein the doorstop means of the header assembly and jamb assembly are provided with a groove opening toward the door member and wherein said groove includes a fire resistant nylon pile mute therein abutting said door member along peripheral edges thereof.

8. A fire resistant aluminum door frame assembly as claimed in claim 1 wherein the jamb member of the jamb assembly and the header member of the header assembly comprise extruded aluminum.

9. A fire resistant aluminum door frame assembly as claimed in claim 1 wherein the steel angle member of the strike assembly is screw attached to the stud means of said partition wall.

10. A fire resistant aluminum door frame assembly as claimed in claim 1 wherein the steel back-up plate of the hinge assembly is screw attached to the stud means of the partition wall.

11. A fire resistant aluminum door frame assembly as claimed in claim 1 wherein the strike plate member resides in longitudinal relationship with said mortising trim strip, said mortising trim strip extending above and below in generally co-planar vertical relationship.

12. A fire resistant aluminum door frame assembly as claimed in claim 1 wherein the steel hinge plate member resides in longitudinal relationship with said mortising trim strip, said mortising trim strip extending above and below in generally co-planar vertical relationship.

13. A fire resistant aluminum door frame assembly as claimed in claim 1 wherein the doorstop member of the header member is notched-out back from the ends of the header member a distance substantially the same as the distance the doorstop means of the jamb member projects outwardly from the jamb member and bevelled inwardly of the adjacent jamb member at an angle of from about 0° to about 10°.

14. A fire resistant aluminum door frame assembly for use in partition wall construction having a door opening therethrough with stud means adjacent opposing vertical sides of the opening, said assembly comprising:

a header assembly having expansion cavity means at opposite upper portions of the door opening, a channel-shaped aluminum header member extending between the cavity means and screw attached to said partition wall along the upper horizontal side of the door opening, aluminum snap-engageable trim members concealing said screw attachment, said trim members having upper and lower snap-engageable legs engaging upper and lower snap-engageable portions of said header member, the lower snap engageable portion terminating short of opposite ends of the header member, said header member including doorstop means projecting downward from, and extending for substantially the full width of, the header member;

opposing jamb assemblies disposed along opposing sides of said door opening and extending downwardly from said header assembly below the expansion cavity means said jamb assembly having channel-shaped aluminum jamb members screw attached to said partition wall, aluminum snap-engageable trim members concealing said screw attachment, said trim members having snap-engageable legs engaging snap-engageable portions of said jamb members, said jamb members including doorstop means projecting outward from, and extending for substantially the full height of, the jamb members, and, an engageable longitudinal slot, adjacent said doorstop, having a mortising trim strip engaged therein;

a strike assembly disposed along one jamb assembly at said engageable slot for accomodation of lockset means of a door member, said strike assembly having an exterior aluminum strike plate member with an opening therethrough permitting entrance of a bolt from a lockset, and further having an interior steel angle member separately screw attached to said jamb member, said steel angle providing retentive engagement for a bolt from a lockset;

at least one hinge assembly disposed along the opposite jamb assembly at said engageable slot, said hinge assembly having an exterior steel hinge plate screw attached to an interior steel back-up plate, the steel back-up plate being separately screw attached to said jamb member and, a door member supported within said door opening by said hinge assembly and having a lockset engaging said strike assembly;

whereby upon exposure to extreme heat, the door frame assembly accommodates expansion of the header and jamb assembly without buckling, and said strike and hinge assemblies respectively maintain said door support and lockset engagement of the door member, wherein said door frame assembly attains a fire rating.

15. A fire resistant aluminum door frame assembly as claimed in claim 14 wherein the lower snap-engageable portion of the header member terminates a distance short of the opposite ends of the header member in the range of from greater than 0" to about 12".

16. A fire resistant aluminum door frame assembly as claimed in claim 14 wherein a gypsum header block is disposed within the channel-shaped header member and extends for substantially the full width of the header member.

17. A fire resistant aluminum door frame assembly as claimed in claim 14 wherein the header member of the header assembly includes two intermediate vertical legs within the channel-shape which extends for substantially the full width of the header member.

18. A fire resistant aluminum door frame assembly as claimed in claim 14 wherein the header assembly trim members and jamb assembly trim members meet at opposite upper corners of the door opening in a mitered relationship.

19. A fire resistant aluminum door frame assembly as claimed in claim 14 wherein the doorstop means of the header assembly and jamb assembly are provided with a groove opening toward the door member and wherein said groove includes a fire resistant nylon pile mute therein abutting said door member along peripheral edges thereof.

20. A fire resistant aluminum door frame assembly as claimed in claim 14 wherein the jamb member of the jamb assembly and the header member of the header assembly comprise extruded aluminum.

21. A fire resistant aluminum door frame assembly as claimed in claim 14 wherein the strike plate member resides in longitudinal relationship with said mortising trim strip, said mortising trim strip extending above and below in generally co-planar vertical relationship.

22. A fire resistant aluminum door frame assembly as claimed in claim 14 wherein the steel hinge plate member resides in longitudinal relationship with said mortising trim strip, said mortising trim strip extending above and below in generally co-planar vertical relationship.

23. A fire resistant aluminum door frame assembly as claimed in claim 14 wherein the doorstop member of the header member is notched-out back from the ends of the header member a distance substantially the same as the jamb member projects outwardly from the jamb member and bevelled inwardly of the adjacent jamb member at an angle of from about 0° to about 10°.

* * * * *